US005236821A

United States Patent [19]

Yagihara et al.

[11] Patent Number: 5,236,821

[45] Date of Patent: Aug. 17, 1993

[54] SILVER HALIDE PHOTOGRAPHIC MATERIAL WHICH CONTAINS A SELENIUM SENSITIZER

[75] Inventors: Morio Yagihara; Tetsuro Kojima; Hiroyuki Mifune; Hirotomo Sasaki, all of Kanagawa, Japan

[73] Assignee: Fuji Photo Film Co., Ltd., Kanagawa, Japan

[21] Appl. No.: 857,492

[22] Filed: Mar. 25, 1992

[30] Foreign Application Priority Data

| | | | |
|---|---|---|---|
| Mar. 25, 1991 | [JP] | Japan | 3-82929 |
| Apr. 3, 1991 | [JP] | Japan | 3-96044 |
| Apr. 3, 1991 | [JP] | Japan | 3-96177 |
| Apr. 4, 1991 | [JP] | Japan | 3-97873 |

[51] Int. Cl.[5] ..... G03C 1/09

[52] U.S. Cl. ..... 430/600; 430/601; 430/603; 430/605

[58] Field of Search ..... 430/601, 603, 600, 605

[56] References Cited

U.S. PATENT DOCUMENTS

| | | | |
|---|---|---|---|
| 3,297,447 | 1/1967 | McVeigh | 430/601 |
| 5,112,733 | 5/1991 | Ihama | 430/603 |

*Primary Examiner*—Janet C. Baxter

*Attorney, Agent, or Firm*—Sughrue, Mion, Zinn, Macpeak & Seas

[57] ABSTRACT

There is disclosed a silver halide photographic material which is sensitized with a novel selenium sensitizer. It provides less fog and markedly little sensitivity degradation during storage under a high temperature and humidity conditions, while providing the same level of a sensitivity. The silver halide photographic material contains at least one compound represented by the following Formula (I):

(I)

Wherein $R_1$ represents a substituted phenyl or condensed aryl group, an aliphatic group, a heterocyclic group, $OR_4$, $—NR_5(R_6)$, $SR_7$, $SeR_8$, $X_1$, or a hydrogen atom; $R_2$ and $R_3$ each represents an aliphatic group, an aromatic group, a heterocyclic group, $OR_9$, $—NR_{10}(R_{11})$, $SR_{12}$, $SeR_{13}$, $X_2$, or a hydrogen atom; $R_5$, $R_6$, $R_{10}$ and $R_{11}$ each represents an aliphatic group, an aromatic group, a heterocyclic group, or a hydrogen atom; $R_4$, $R_7$, $R_8$, $R_9$, $R_{12}$ and $R_{13}$ each represents an aliphatic group, an aromatic group, a heterocyclic group, a hydrogen atom, or a cation; and $X_1$ and $X_2$ each represents a halogen atom.

12 Claims, No Drawings

SILVER HALIDE PHOTOGRAPHIC MATERIAL WHICH CONTAINS A SELENIUM SENSITIZER

FIELD OF THE INVENTION

The present invention relates to a silver halide photographic material, specifically to a silver halide photographic material containing a silver halide emulsion which exhibits little fogging or sensitivity change during storage.

BACKGROUND OF THE INVENTION

A silver halide emulsion used in a silver halide photographic material is usually chemically sensitized with various chemical substances in order to obtain a prescribed sensitivity and gradation. Typical methods for doing so include various sensitizing methods such as sulfur sensitization, selenium sensitization, tellurium sensitization, noble metal sensitization such as gold sensitization, reduction sensitization, and combinations thereof.

In recent years, there has bean a strong demand for high sensitivity, excellent graininess and high sharpness in a silver halide photographic material as well as for rapid processing in which development processing is expedited. Various improvements in the above sensitizing methods have been made.

Of the above sensitizing methods, the selenium sensitization and tellurium sensitization are disclosed in U.S. Pat. Nos. 1,574,944, 1,602,592, 1,623,499, 3,297,446, 3,297,447, 3,320,069, 3,408,196, 3,408,197, 3,442,653, 3,420,670, 3,591,385, 3,772,031, 3,531,289, and 3,655,394, French Patents 2,093,038 and 2,093,209, JP-B-52-34491 (the term "JP-B" as used herein means an examined Japanese patent publication), JP-B-52 34492, JP-B-53-295, and JP-B-57-22090, JP A-59-180536 (the term "JP-A" as used herein means an unexamined published Japanese patent application), JP-A-59-185330, JP A-59-181337, JP-A-59-187338, JP-A-59-192241, JP-A-60-150046, JP A-60-151637, and JP-A-61-246738, British Patents 255,846, 861,984, 235,211, 1,121,496, 1,295,462, and 1,396,696, Canadian Patent 800,958, and *Journal Photographic Science, Vol.* 31, pp. 158 to 169 (1983), written by H. E. Spencer et al.

However, while the selenium sensitization has a greater sensitizing effect than the sulfur sensitization usually applied in the art, it has a marked tendency to cause too much fog and soften a gradation. Many of the above-cited patents improve the above defects, but the results obtained are still insufficient. In particular, a basic improvement to control the generation of fog has been intensively desired.

In particular, the combination of gold sensitization with sulfur sensitization or selenium sensitization can provide a marked increase in sensitivity, but at the same time there is an increase in fog. The gold-selenium sensitization particularly causes the fog to increase compared to gold-sulfur sensitization. Accordingly, there has been an intensive search for selenium sensitizers in which sensitivity change during storage is controlled nd the generation of fog is suppressed.

SUMMARY OF THE INVENTION

An object of the present invention is to provide a highly sensitive silver halide photographic material having less fog and an excellent preserving property.

This and other objects of the present invention can be achieved by a silver halide photographic material containing a silver halide emulsion which has been subjected to selenium sensitization with at least one compound represented by the following Formula (I):

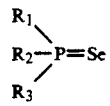

(I)

wherein $R_1$ represents a substituted phenyl or condensed aryl group, an aliphatic group, a heterocyclic group, $OR_4$, $—NR_5(R_6)$, $SR_7$, $SeR_8$, $X_1$, or a hydrogen atom; $R_2$ and $R_3$ each represents an aliphatic group, an aromatic group, a heterocyclic group, $OR_9$, $—NR_{10}(R_{11})$, $SR_{12}$, $SeR_{13}$, $X_2$, or a hydrogen atom; $R_5$, $R_6$, $R_{10}$ and $R_{11}$ each represents an aliphatic group, an aromatic group, a heterocyclic group, or a hydrogen atom; $R_4$, $R_7$, $R_8$, $R_9$, $R_{12}$ and $R_{13}$ each represents an aliphatic group, an aromatic group, a heterocyclic group, a hydrogen atom, or a cation; and $X_1$ and $X_2$ each represents a halogen atom. The present invention makes it possible to obtain a sufficient sensitizing effect provided by selenium sensitization, which has been impossible in the prior art.

DETAILED DESCRIPTION OF THE INVENTION

Formula (I) is explained in detail.

In Formula (I), the aliphatic group represented by $R_1$, $R_2$, $R_3$, $R_4$, $R_5$, $R_6$, $R_7$, $R_8$, $R_9$, $R_{10}$, $R_{11}$, $R_{12}$ or $R_{13}$ has preferably 1 to 30 carbon atoms and is particularly a linear, branched or cyclic alkyl group, alkenyl group or alkynyl group each having 1 to 20 carbon atoms. The alkyl group, alkenyl group and alkynyl group include, for example, methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, and 3-pentynyl groups.

In Formula (I), the heterocyclic group represented by $R_1$, $R_2$, $R_3$, $R_4$, $R_5$, $R_6$, $R_7$, $R_8$, $R_9$, $R_{10}$, $R_{11}$, $R_{12}$ or $R_{13}$ is a saturated or unsaturated, 3 to 10-membered heterocyclic group containing at least one of a nitrogen atom, an oxygen atom and a sulfur atom. It may be a single ring or form a condensed ring with another aromatic ring or heterocyclic ring. The heterocyclic group is preferably a 5- to 6-membered aromatic heterocyclic group. Examples thereof include a pyridyl group, a furyl group, a thienyl group, a thiazolyl group, an imidazolyl group, and a benzimidazolyl group.

In Formula (I), the condensed aryl group represented by $R_1$ has 10 to 30 carbon atoms, and for example, a naphthyl group.

In Formula (I), the following groups can be given as examples of the substituent for the phenyl group represented by $R_1$: an alkyl group, an aralkyl group, an alkenyl group, an alkynyl group, an aryl group, an alkoxy group, an aryloxy group, an amino group, an acylamino group, a ureido group, a urethane group, a sulfonylamino group, a sulfamoyl group, a carbamoyl group, a sulfonyl group, a sulfinyl group, an alkyloxycarbonyl group, an aryloxycarbonyl group, an acyl group, an acyloxy group, a phosphoric acid amide group, a diacylamino group, an imido group, an alkylthio group, an arylthio group, a halogen atom, a cyano group, a sulfo group, a carboxy group, a hydroxyl group, a phosphono group, a nitro group, and a heterocyclic group. These groups may further be substituted.

If the phenyl group has two or more substituents, they may be the same or different.

In Formula (I), the aromatic group represented by $R_2$, $R_3$, $R_4$, $R_5$, $R_6$, $R_7$, $R_8$, $R_9$, $R_{10}$, $R_{11}$, $R_{12}$ or $R_{13}$ has preferably 6 to 30 carbon atoms and is particularly a single or condensed aryl group having 6 to 20 carbon atoms. Examples thereof include a phenyl group and a naphthyl group.

In Formula (I), the cation represented by $R_4$, $R_7$, $R_8$, $R_9$, $R_{12}$ or $R_{13}$ may be an alkali metal or an ammonium group.

In Formula (I), the halogen atom represented by $X_1$ or $X_2$ is, for example, a fluorine atom, a chlorine atom, a bromine atom or an iodine atom.

Further, these aliphatic groups, aromatic groups and heterocyclic groups may be substituted. The following groups are examples of the substituents: an alkyl group, an aralkyl group, an alkenyl group, an alkynyl group, an aryl group, an alkoxy group, an aryloxy group, an amino group, an acylamino group, a ureido group, a urethane group, a sulfonylamino group, a sulfamoyl group, a carbamoyl group, a sulfonyl group, a sulfinyl group, an alkyloxycarbonyl group, an aryloxycarbonyl group, an acyl group, an acyloxy group, a phosphoric acid amide group, a diacylamino group, an imido group, an alkylthio group, an arylthio group, a halogen atom, a cyano group, a sulfo group, a carboxy group, a hydroxyl group, a phosphono group, a nitro group, a phosphineselenoyl group, and a heterocyclic group. These groups may further be substituted. If two or more substituents are present, they may be the same or different.

$R_1$, $R_2$ and $R_3$ may be combined with each other to form a ring together with the phosphorus atom. Also, $R_5$ and $R_6$, or $R_{10}$ and $R_{11}$, may be combined with each other to form a nitrogen-containing heterocyclic ring.

The one embodiment of the present invention, in Formula (I), $R_1$ represents a substituted phenyl or condensed aryl group, an aliphatic group, or a heterocyclic group; and $R_2$ and $R_3$ each represents an aliphatic group, an aromatic group, or a heterocyclic group. Examples of the compounds falling within this embodiment are shown below, but the compounds of the present invention are not limited thereto.

1 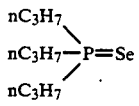

2 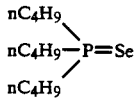

3 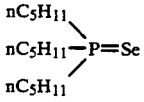

4 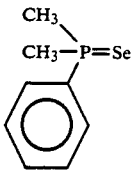

-continued

5 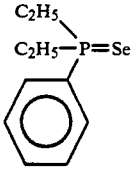

6 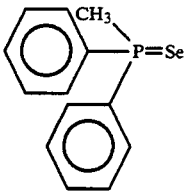

7 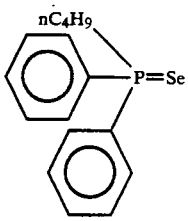

8 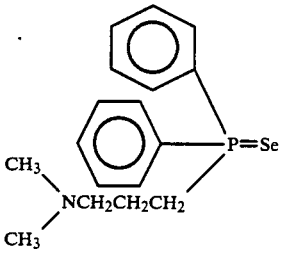

9 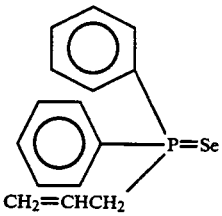

10 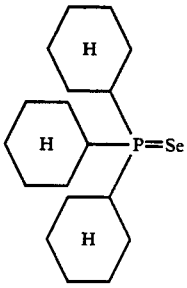

-continued
11
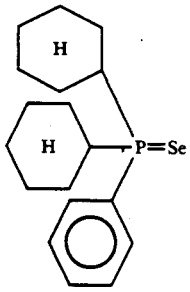
12
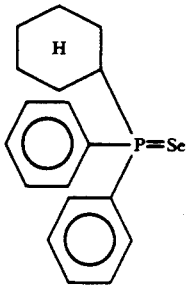
13
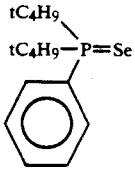
14
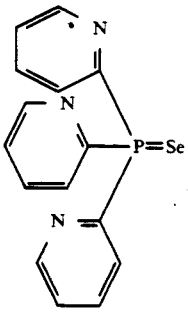
15
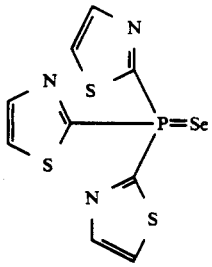
16
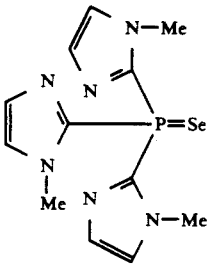
-continued
17
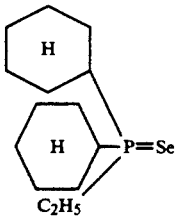
18
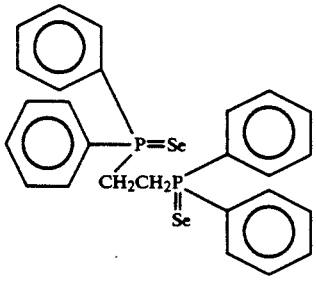
19
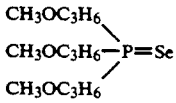
20
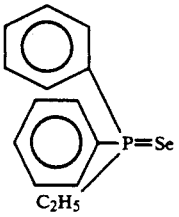
21
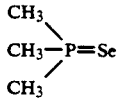
22
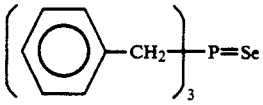
23
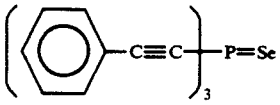
24
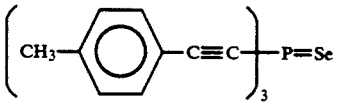
25
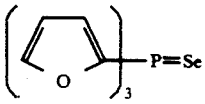
26
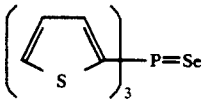

-continued
27
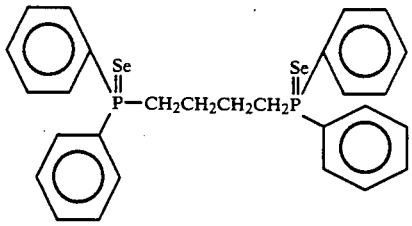
28
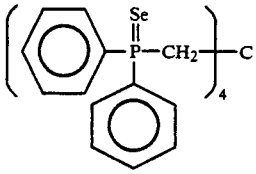
29
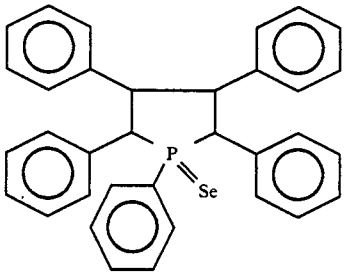
30
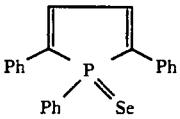
31
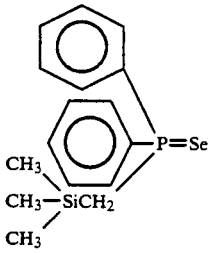
41
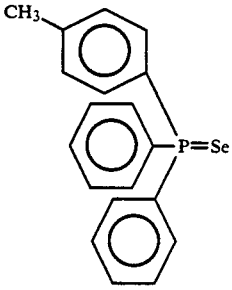
-continued
42
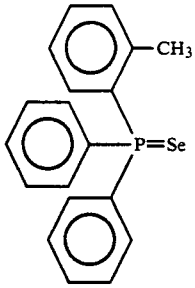
43
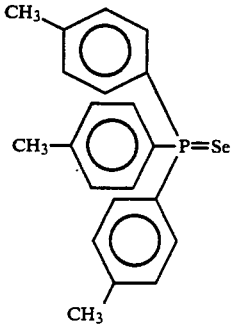
44
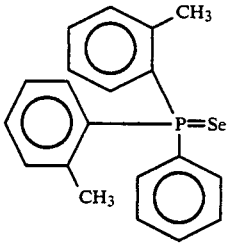
45
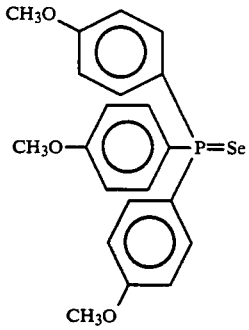
46
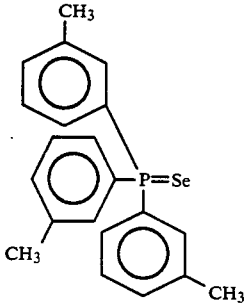

-continued
47
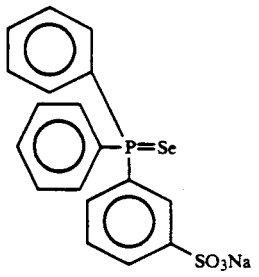
48
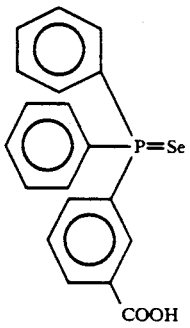
49
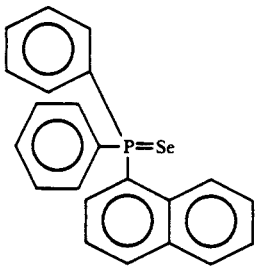
50
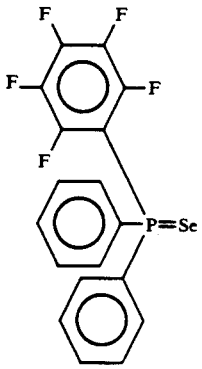
-continued
51
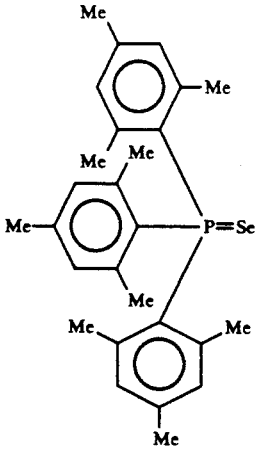
52
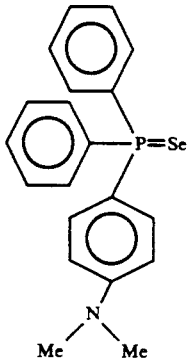
53
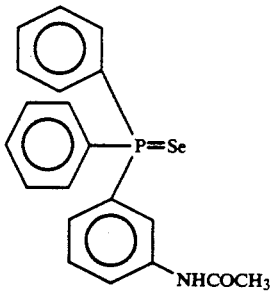
54
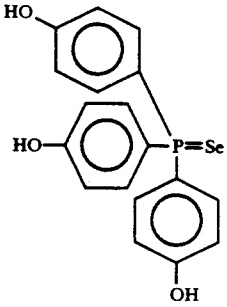

-continued

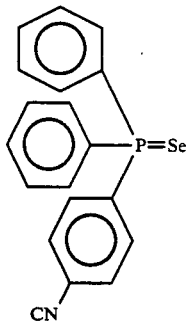

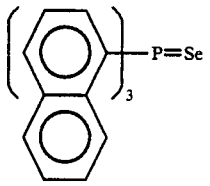

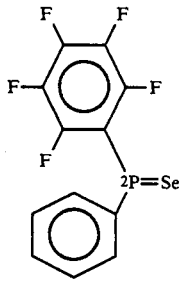

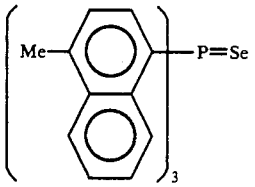

-continued

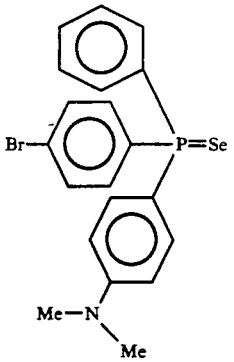

In general, these compounds can be synthesized by the reaction of a tertiary arylphosphine with selenium or selenocyanate. To be concrete, they can be synthesized according to the methods described in *J. Org. Chem.*, vol. 27, p. 2573 (1962), *J. Chem. Eng. Data*, vol. 8, p. 226 (1963), *Inorganic Chemistry*, vol. 5, p. 1297 (1966), *Inorg. Chem. Acta.*, vol. 2, p. 309 (1968), *Ann.*, vol. 315, p. 43 (1901), *J. Chem. Soc.*, 276 (1944), *J. Amer. Chem. Soc.*, vol. 43, p. 916 (1921), *Ann.*, vol. 181, p. 265 (1876), *Z. Kristallogr.*, vol. 130, p. 239 (1969), *Naturwiss.*, vol. 50, p. 403 (1963), *Chem. Ber.*, vol. 99, p. 712 (1966), *J. Mol. Spectrosc.*, vol. 33, p. 474 (1970), *J. Chem., Soc., Chem., Commun.*, 234 (1967), *Chem., Ber.*, vol. 100, p. 2220 (1967), *J. Amer. Chem. Soc.*, vol. 83, p. 4406 (1961), *J. Chem. Soc.*, 2184 (1965), and *Akad. Nauk, SSSR, Ser. Khim.*, 286 (1965).

In another embodiment of the present invention, in Formula (I), $R_1$ represents $OR_4$; $R_2$ and $R_3$ each represents $OR_9$; $R_4$ represents a substituted alkyl group, an alkenyl group, an alkynyl group, a heterocyclic group, a hydrogen atom, or a cation; and $R_9$ represents an aliphatic group, an aromatic group, a heterocyclic group, a hydrogen atom, or a cation. Examples of the compounds falling within this embodiment are shown in Table 1 below. As a matter of course, the compounds of the present invention are not limited thereto.

TABLE 1

| No. | $R_1$ | $R_2$ | $R_3$ |
|---|---|---|---|
| 101 | —ONa | $-OC_2H_5$ | $-OC_2H_5$ |
| 102 | $-OCH_2CH_2OH$ | $-OCH_2CH_2OH$ | $-OCH_2CH_2OH$ |
| 103 | $-OCH_2CH_2CN$ | 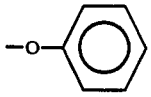 | 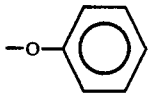 |
| 104 | $-OCH_2CH=CH_2$ | $-OC_2H_5$ | $-OC_2H_5$ |
| 105 | $-OCH_2COOH$ | 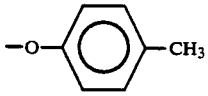 | 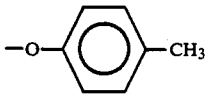 |
| 106 | $-OCH_2CH_2OH$ | $-OC_4H_9^t$ | $-OC_4H_9^t$ |
| 107 | $-OCH_2CH_2SCH_3$ | $-OC_8H_{17}^n$ | $-OC_8H_{17}^n$ |
| 108 | $-OCH_2CH_2CN$ | $-OCH_2CH_2CN$ | $-OCH_2CH_2CN$ |
| 109 | $-OCH_2COOH$ | 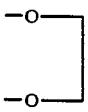 | |

TABLE 1-continued

| No. | $R_1$ | $R_2$ | $R_3$ |
|---|---|---|---|
| 110 | $-OCH_2CH_2SO_2CH_3$ | $-OC_2H_5$ | $-OC_2H_5$ |

In general, the compounds described in Table 1 can be synthesized by the reactions shown below:

Reaction A

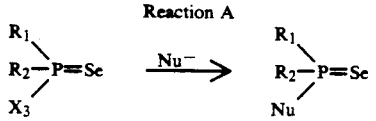

$Nu^-$: $OR_9^-$
$X_3$: a halogen atom

Reaction B

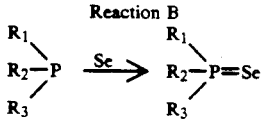

To be concrete, the above compounds can be synthesized according to the methods described in, for example, *Z. Naturforsch., Part B*, 24, 179 (1969), *Monatsh, Chem.*, 99, 1153 (1968), *Ind. Eng. Chem.*, 43, 876, (1951), *Chem. Zvesti*, 9, 3 (1955), *J. Org. Chem.*, 29, 1006 (1964), and *Izv. Acad. Nauk SSSR, Ser. Khim*, (1968).

In a further embodiment of the present invention, in Formula (I), $R_1$ represents $OR_4$; $R_2$ represents an aliphatic group, an aromatic group, or a heterocyclic group; $R_3$ represents $OR_9$, an aliphatic group, an aromatic group, or a heterocyclic group; and $R_4$ and $R_9$ each represents an aliphatic group, an aromatic group, a heterocyclic group, a hydrogen atom, or a cation. Examples of the compounds falling within this embodiment are shown in Table 2 below. As a matter of course, the compounds of the present invention are not limited thereto.

TABLE 2

| No. | $R_1$ | $R_2$ | $R_3$ |
|---|---|---|---|
| 201 | $-OCH_3$ | 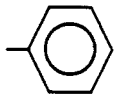 | $-OCH_3$ |
| 202 | $-OCH_3$ | $-CH_3$ | $-OCH_3$ |
| 203 | $-OCH_3$ | 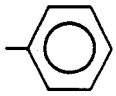 | 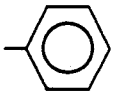 |
| 204 | $-OCH_3$ | $-CH_2CH{=}CHCH_2Cl$ | $-OCH_3$ |
| 205 | $-OC_2H_5$ | $-C_2H_5$ | $-OC_2H_5$ |
| 206 | $-OC_2H_5$ | $-OC_2H_5$ | 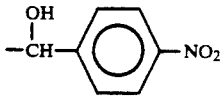 |
| 207 | $-OC_2H_5$ | $-OC_2H_5$ | $-CH_2CH_2CN$ |
| 208 | 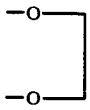 | | $-CH_3$ |
| 209 | 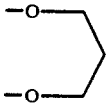 | | $-CH_3$ |
| 210 | 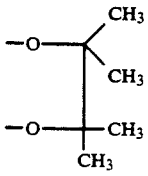 | | $-CH_3$ |
| 211 | $-OC_4H_9^t$ | 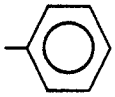 | 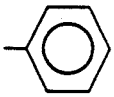 |

TABLE 2-continued

| No. | $R_1$ | $R_2$ | $R_3$ |
|---|---|---|---|
| 212 | $-OC_8H_{17}^n$ | 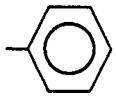 | 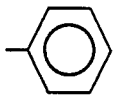 |
| 213 | $-OC_2H_5$ | 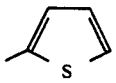 | $-OC_2H_5$ |
| 214 | 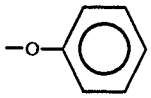 | $-C_2H_5$ | $-C_2H_5$ |
| 215 | 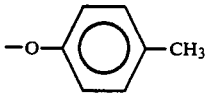 | $-C_4H_9^n$ | $-C_4H_9^n$ |
| 216 | $-OC_2H_5$ | 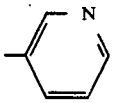 | $-OC_2H_5$ |

In general, the compounds shown in Table 2 can be synthesized by the reactions shown below:

Reaction C

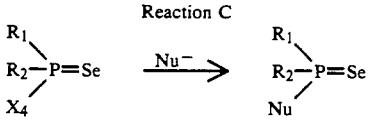

$Nu^-$: $OR_9^-$
$X_4$: a halogen atom

Reaction D

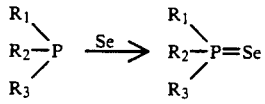

To be concrete, the above compounds can be synthesized according to the methods described in, for example, *Z. Naturforsch., Part B,* 24, 179 (1969), *Monatsh, Chem.,* 99, 1153 (1968), *Izv. Acad. Nauk SSSR, Ser Khim,* 894 (1952), *Zh. Obshch, Khim.,* 26, 2463 (1956), and *J. Chem. Phys.,* 64, 1692 (1966).

In even another embodiment of the present invention, in Formula (I), $R_1$ represents $-NR_5(R_6)$, $SR_7$, $SeR_8$, $X_1$, or a hydrogen atom; $R_2$ and $R_3$ each represents an aliphatic group, an aromatic group, a heterocyclic group, $OR_9$, $-NR_{10}(R_{11})$, $SR_{12}$, $SeR_{13}$, $X_2$, or a hydrogen atom; $R_5$, $R_6$, $R_{10}$ and $R_{11}$ each represents an aliphatic group, an aromatic group, a heterocyclic group, or a hydrogen atom; $R_7$, $R_8$, $R_9$, $R_{12}$ and $R_{13}$ each represents an aliphatic group, an aromatic group, a heterocyclic group, a hydrogen atom, or a cation; and $X_1$ and $X_2$ each represents a halogen atom. Examples of the compounds falling within this embodiment are shown in Table 3 below. As a matter of course, the compounds of the present invention are not limited thereto.

TABLE 3

| No. | $R_1$ | $R_2$ | $R_3$ |
|---|---|---|---|
| 301 | $-N(CH_3)_2$ | $-N(CH_3)_2$ | $-N(CH_3)_2$ |

TABLE 3-continued

| No. | $R_1$ | $R_2$ | $R_3$ |
|---|---|---|---|
| 302 | $-N(CH_3)_2$ | $-N(CH_3)_2$ | 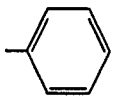 |
| 303 | $-N(CH_3)_2$ | 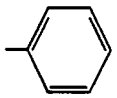 | 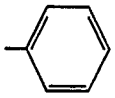 |
| 304 | $-N(C_2H_5)_2$ | $-OCH_3$ | 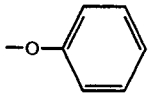 |
| 305 | $-SH$ | $-C_2H_5$ | $-OC_2H_5$ |
| 306 | $-SCH_3$ | $-SCH_3$ | $-SCH_3$ |
| 307 | $-SC_4H_9^n$ | $-SC_4H_9^n$ | $-SC_4H_9^n$ |
| 308 | $-SCH_3$ | $-CH_3$ | $-CH_3$ |
| 309 | $-SCH(CH_3)C_4H_9$ | $-OC_2H_5$ | $-OC_2H_5$ |
| 310 | 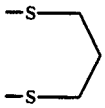 | | $-CH_3$ |
| 311 | 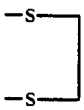 | | $-CH_3$ |
| 312 | $-SC_3H_6CN$ | $-C_2H_5$ | $-OC_2H_5$ |
| 313 | $-SeNa$ | $-C_2H_5$ | $-C_2H_5$ |
| 314 | $-SeC_2H_5$ | $-OC_2H_5$ | $-OC_2H_5$ |
| 315 | $-SeCH_3$ | $-OCH_3$ | 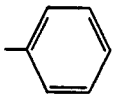 |

TABLE 3-continued

| No. | $R_1$ | $R_2$ | $R_3$ |
|---|---|---|---|
| 316 | $-SeCH_3$ | 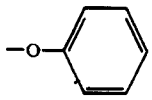 | 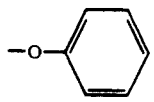 |
| 317 | H | $-OCH_3$ | $-OCH_3$ |
| 318 | H | 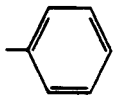 | 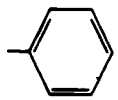 |
| 320 | Cl | $-C_2H_5$ | $-OC_2H_5$ |
| 321 | Cl | $-C_2H_5$ | 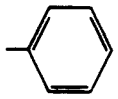 |

In general, the compounds shown in Table 3 can be synthesized by the reactions shown below:

Reaction E

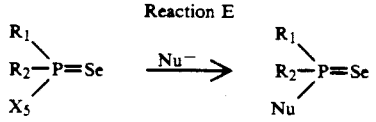

$Nu^-$: $OR_9^-$, $HNR_{10}R_{11}$, $SR_{12}^-$
$X_5$: a halogen atom

Reaction F

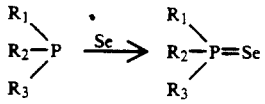

Reaction G

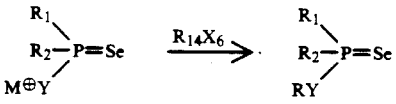

Y: S, Se
$M^{\oplus}$: Na, K and the like
$R_{14}$: an aliphatic group
$X_6$: a halogen atom,

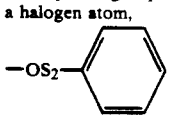

and the like

To be concrete, the above compounds can be synthesized according to the methods described in, for example, *Rocz. Chem.*, 34, 1675 (1960), *Chem. Ber.*, 49, 63 (1961), *Zh. Obshch. Khim.*, 36, 1240 (1966), *Z. Naturforsch., Part B*, 24, 179 (1969), *Helv. Chem. Acta.*, 46, 2667 (1963), *Dokl. Akad. Nauk SSSR*, 163, 1397 (1965), *Bull. Acad. Pol. Soc., Ser. Sci. Chem.*, 14, 217 (1966), *Angew. Chem.* (Inter. Ed.), 3, 586 (1964), *Bull. Acad. Pol. Sci., Ser. Sci. Chem.*, 14 303 (1966) *Chem. Commun.*, 913 (1969), *Can. J. Chem.*, 46, 1415 (1968), *Izv. Acad. Nauk SSSR, Ser. Khim.*, 464 (1969), *Zh. Obshch Khim.*, 36, 923 (1966), *Zh. Obshch. Khim.*, 37, 959 (1967), *Zh. Obshch. Khim.*, 39, 2265 (1969), *Izv. Acad. Nauk SSSR, Ser. Khim.*, 1606 (1967), *Izv. Acad. Nauk SSSR, Ser. Khim.*, 169 (1969), *Izv. Acad. Nauk SSSR, Ser. Khim.*, 622 (1970), and *Helv. Chem. Acta.*, 49, 1000 (1966).

There have not so far been reported the concrete examples in which the compounds of Formula (I) are used as a selenium sensitizer. Accordingly, it has been very difficult to estimate a sensitizing capacity, fog and other photographic properties of these compounds. However, the use of the compounds of the present invention has made it possible to obtain a marked effect.

The amount of the selenium sensitizer used in the present invention depends on the selenium compound, silver halide grains and chemical sensitization conditions. The amount is generally about $10^{-8}$ to $10^{-4}$ mole, preferably $10^{-7}$ to $10^{-5}$ mole, per mole of silver halide.

The conditions for chemical sensitization in the present invention are not specifically limited. The pAg is 6 to 11, preferably 7 to 11, and more preferably 7 to 9.5. The temperature is 40° to 95° C., preferably 50° to 85° C.

In the present invention, noble metal sensitizers such as gold, platinum, palladium and iridium are preferably used in combination with the compounds of Formula (I). In particular, the gold sensitizer is preferably used in combination with the compounds of Formula (I). Specific gold sensitizers include chloroauric acid, potassium chloroaurate, potassium aurithiocyanate, gold sulfide and gold selenide. The amount thereof to be used is about $10^{-7}$ to $10^{-2}$ mole per mole of silver halide.

Further, in the present invention, a sulfur sensitizer is also preferably used in combination with the compounds of Formula (I). To be concrete, these sensitizers include known unstable sulfur compounds such as thiosulfates (for example, hypo), thioureas (for example, diphenyl thiourea, triethyl thiourea and allyl thiourea) and rhodanine. They can be used in an amount of about $10^{-7}$ to $10^{-2}$ mole per mole of silver halide.

In the present invention, it is also possible to use a reduction sensitizer in combination with the compounds of Formula (I). Examples of the reduction sensitizer include stannous chloride, aminoiminomethanesulfinic acid, a hydrazine derivative, a borane compound, a silane compound, and a polyamine compound.

Further, in the present invention, selenium sensitization is preferably carried out in the presence of a silver halide solvent.

Examples of the silver halide solvents include thiocyanates (for example, potassium thiocyanate), thioether compounds (for example, the compounds described in U.S. Pat. Nos. 3,021,215 and 3,271,157, JP-B-8-30571, and JP-A-60-136736, particularly, 3,6-dithia-1,8-octanediol), tetra-substituted thiourea compounds (for example, the compounds described in JP-B-59-11892, and U.S. Pat. No. 4,221,863, particularly, tetramethyl thiourea), the thione compounds described in JP-B-60-11341, the mercapto compounds described in JP-B-63-29727, the mesoionic compounds described in JP-A-60-163042, the selenoether compounds described in U.S. Pat. No. 4,782,013, and the telluroether compounds and sulfites described in JP-A-2-118566. Of these compounds, the thiocyanates, thioether compounds, tetra-substituted thiourea compounds and thione compounds are particularly preferable. They can be used in an amount of about $10^{-5}$ to $10^{-2}$ mole per mole of silver halide.

The silver halide emulsion used in the present invention comprises preferably silver bromide, silver bromoiodide, silver bromochloroiodide, silver bromochloride, and/or silver chloride.

The silver halide grains used in the present invention are of regular crystals such as cubic or octahedral crystals, irregular crystals such as spherical or tabular crystals, or composite crystals thereof. There can also be used emulsions which comprise a mixture of grains having various crystal forms. The silver halide grains having regular crystal forms are preferably used.

The silver halide grains used in the present invention may have the structure in which the composition of the internal portion is different from that of the surface portion, or the structure in which the composition is uniform throughout the grains. Also, they may be grains in which a latent image is formed primarily on the surface thereof (for example, a negative type emulsion), or grains in which the latent image is formed primarily in the internal portion thereof (for example, an internal latent image type emulsion and pre-fogged direct reversal type emulsion). Preferred are the grains in which a latent image is formed primarily on the surface thereof.

The silver halide emulsion used in the present invention comprises preferably tabular grains which have a thickness of 0.5 μm or less, preferably 0.3 μm or less, a diameter of preferably 0.6 μm or more, and in which the average aspect ratio is 5 or more, accounts for 50% or more of the total projected area of the grains. The silver halide emulsion of the present invention is also preferably a monodispersed emulsion having a statistical variation coefficient of 20% or less, wherein the variation coefficient is defined by the value obtained by dividing a standard deviation in the distribution of the diameters of the circles corresponding to the projected areas of the grains with the average diameter. Also, it may be the emulsion prepared by mixing two or more kinds of tubular grain emulsion and a monodispersed emulsion.

The photographic emulsions used in the present invention can be prepared by the methods described in *Chimie et Physique Photographeque* written by P. Glafkides (published by Paul Montel Co., 1967), *Photographic Emulsion Chemistry* written by G. F. Duffin (published by The Focal Press, 1966), and *Making and Coating Photographic Emulsion* written by V. L. Zelikman et al (published by The Focal Press, 1964).

In order to control the growth of the grains in forming the silver halide grains, one can used as the silver halide solvent, for example, ammonia, potassium rhodanide, ammonium rhodanide, thioether compounds (for example, U.S. Pat. Nos. 3,271,157, 3,574,628, 3,704,130, 4,297,439, and 4,276,374), thione compounds (for example, JP-A-53-144319, JP-A-53-82408 and JP-A-55-77737), and amine compounds (for example, JP-A-54-100717).

A cadmium salt, a zinc salt, a thallium salt, an iridium salt or a complex salt thereof, a rhodium salt or a complex salt thereof, and an iron salt or a complex salt thereof may be present during the step of formation of silver halide grains or physical ripening.

Gelatin is advantageously used as a binder or protective colloid which can be used for an emulsion layer and an interlayer of the light-sensitive material of the present invention. Hydrophilic colloids other than gelatin can be used as well. For example, proteins can be used such as gelatin derivatives, graft polymers of gelatin and other polymers, albumin and casein; cellulose derivatives such as hydroxyethyl cellulose, carboxymethyl cellulose and cellulose sulfuric acid esters; sucrose derivatives such as sodium alginate and starch derivatives; and various synthetic hydrophilic polymers such as homopolymers and copolymers of vinyl alcohol, partially-acetalized vinyl alcohol, N-vinylpyrrolidone, acrylic acid, methacrylic acid, acrylamide, vinylimidazole, and vinylpyrazole.

One may use acid-treated gelatin and enzyme-treated gelatin described in *Bull. Soc. Phot. Japan*, No. 16, p. 30 (1966) as well as conventional lime-treated gelatin. A hydrolysis product of gelatin can be used as well.

An inorganic or organic hardener may be incorporated into any hydrophilic colloid layers constituting a photographic light-sensitive layer and into a back layer of the light-sensitive material of the present invention. For example, concrete examples include a chromium salt, an aldehyde (e.g., formaldehyde, glyoxal and glutaric aldehyde), and an N-methylol compound (e.g., dimethylolurea). Preferred are an active halogen compound (e.g., 2,4-dichloro-6-hydroxy-1,3,5-triazine and a sodium salt thereof) and an active vinyl compound [e.g., 1,3-bis(vinylsulfonyl)-2-propanol, 1,2-bis(vinylsulfonylacetamido)ethane, bis(vinylsulfonylmethyl) ether, and a vinyl type polymer having a vinylsulfonyl group on a side chain] because they harden hydrophilic colloids such as gelatin and provide stable photographic properties. N-Carbamoylpyridinium salts [e.g., (1-morphorinocarbonyl-3-pyridinio)methanesulfonate] and haloamidinium salts [e.g., 1-(1-chloro-1-pyridinomethylene)pyrolidinium-2-naphthalenesulfonate] have a rapid hardening speed and are excellent.

The silver halide photographic emulsions used in the present invention may be sensitized with a methine dye or other dyes. They include a cyanine dye, a merocyanine dye, a complex cyanine dye, a complex merocyanine dye, a holopolar cyanine dye, a hemicyanine dye, a styryl dye, and a hemioxonol dye. Particularly useful are a cyanine dye, a merocyanine dye, and a dye belonging to a complex merocyanine dye. Any of the nuclei of the cyanine dyes can usually be applied to these dyes as a basic heterocyclic ring nucleus. One can use a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; the nuclei formed by condensing these nuclei with alicyclic hydrocarbon rings; and the nuclei formed by condensing these nuclei with aromatic hydrocarbon rings, that is, an indolenine nucleus, a benzindolenine nucleus, an indole ring, a benzoxazole nucleus, a naphthoxazole nucleus, a benzothiazole nucleus, a naphthothiazole nucleus, a benzoselenazole nucleus, a benzimidazole nucleus, and a quinoline nucleus. These nuclei may have substituents on the carbon atoms.

A 5- to 6-membered heterocyclic ring nucleus such as a pyrazolin-5-one nucleus, a thiohydantoin nucleus, a 2-thioxazolidin-2,4-dione nucleus, a thiazolidin-2,4-dione nucleus, a rhodanine nucleus, and a thiobarbituric acid nucleus can be applied to the merocyanine dyes or complex merocyanine dyes as a nucleus having a keto-methylene structure.

These sensitizing dyes may be used singly or in a combination thereof. The combination of the sensitizing dyes is often used, particularly for the purpose of supersensitization. In addition to the sensitizing dyes, the emulsions may contain dyes which themselves have no spectral sensitization effect or substances which absorb substantially no visible ray and have a supersensitization effect. For example, they may contain an aminostilbene compound substituted with a nitrogen-containing heterocyclic nucleus group (described, for example, in U.S. Pat. Nos. 2,933,390 and 3,635,721), an aromatic organic acid formaldehyde condensed compound (described, for example, in U.S. Pat. No. 3,743,510), a cadmium salt, and an azaindene compound. Particularly useful are the combinations described in U.S. Pat. Nos. 3,615,613, 3,615,641, 3,617,295, and 3,635,721.

The photographic emulsions of the present invention can contain various compounds for the purposes of preventing fog in preparing, storing and photographically processing a light-sensitive material and stabilizing photographic properties. One can add many compounds which are known as anti-foggants and stabilizers, such as azoles, for example, a benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (in particular, 1-phenyl-5-mercaptoterazole); mercaptopyrimidines; mercaptotriazines; a thioketo compound, for example, such as oxazolinethione; azaindenes, for example, triazaindenes, tetrazaindenes [in particular, -hydroxy-substituted (1,3,3a,7)tetrazaindenes], and pentaazaindenes; benzenethiosulfonic acid, benzenesulfinic acid, and benzenesulfonic acid amide.

The light-sensitive material of the present invention may contain one or more kinds of a surface active agent for various purposes such as aiding coating, anti-electrification, improvement in a sliding property, emulsification-dispersion, anti-adhesion, and improvement in the photographic properties (for example, development acceleration, high contrast and sensitization).

The light-sensitive material prepared according to the present invention may contain a water soluble dye in a hydrophilic colloid layer as a filter dye or for other purposes such as anti-irradiation, anti-halation and others. Preferably used as a such dye are an oxonol dye, a hemioxonol dye, a styryl dye, a merocyanine dye, an anthraquinone dye, and an azo dye. Also useful are a cyanine dye, an azomethine dye, a triarylmethane dye and a phthalocyanine dye. It is also possible to add an oil soluble dye emulsified by an oil-in-water dispersion method to a hydrophilic colloid layer.

The present invention can be used as a multicolor light-sensitive material comprising a support having thereon a multilayer having at least two different spectral sensitivities. The multilayer color photographic light-sensitive material usually has at least one red-sensitive emulsion layer, one green-sensitive emulsion layer and one blue-sensitive emulsion layer on a support. The order of these layers can be arbitrarily selected according to necessity. A preferred layer arrangement is the order of (i) a red-sensitive layer, a green-sensitive layer and a blue-sensitive layer, (ii) a blue-sensitive layer, a green-sensitive layer and a red-sensitive layer, or (iii) a blue-sensitive layer, a red-sensitive layer and a green-sensitive layer, from a support side. Further, emulsion layers having the same spectral sensitivity may consist of two or more emulsion layers having different sensitivities to improve the final sensitivity thereof, or the emulsion layer may constitute three layers to improve a graininess. A non-light-sensitive layer may exist between two or more emulsion layers which have the same spectral sensitivity. The layer structure may be such that an emulsion layer having a different spectral sensitivity is interposed between the emulsion layers which have the same spectral sensitivity. A reflection layer containing fine silver halide grains may be provided under a high sensitive layer, in particular a high sensitivity blue-sensitive layer to increase sensitivity.

While the red-sensitive emulsion layer, the green-sensitive emulsion layer, and the blue-sensitive emulsion layer generally contain a cyan-forming coupler, a magenta-forming coupler, and a yellow-forming coupler, respectively, different combinations can be taken as the case may be. For example, the combination of red-sensitive layers can be used for pseudo color photography or semi-conductor laser exposure.

Various color couplers can be used for the photographic material of the present invention. Concrete examples thereof are described in the patents abstracted in *Research Disclosure* (RD) No. 17643, VII-C to G.

Preferred as a yellow coupler are the couplers described in, for example, U.S. Pat. Nos. 3,933,501, 4,022,620, 4,326,024, and 4,401,752, JP-B-58-10739, and British Patents 1,425,020 and 1,476,760.

The 5-pyrazolone type and pyrazoloazole type compounds are preferred as a magenta coupler. Preferred are the compounds described in, for example, U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-6043659, and U.S. Pat. Nos. 4,500,630 and 4,540,654.

The cyan coupler can be a phenol type or a naphthol type couplers. Preferred are the compounds described in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173; German Patent (OLS) No. 3,329,729; European Patent 121,365A; U.S. Pat. Nos. 3,446,622, 4,333,999, 4,451,559, and 4,427,767; and European Patent 161,626A.

Preferred as a colored coupler used for correcting unnecessary absorption of a developed dye are the compounds described in, for example, *Research Disclosure* No. 17643, VII-G, U.S. Pat. No. 4,163,670, JP-B-57-39413, U.S. Pat. Nos. 4,004,929 and 4,138,258, and British Patent 1,146,368.

Preferred as a coupler capable of forming a developed dye having an appropriate dispersing property are the compounds described in, for example, U.S. Pat. No. 4,366,237, British Patent 2,125,570, European Patent 96,570, and German Patent (OLS) No. 3,234,533.

The typical examples of a dye-forming polymer coupler are described in U.S. Pat. Nos. 3,451,820, 4,080,211, and 4,367,282, and British Patent 2,102,173.

Also, there can be preferably used a coupler releasing a photographically useful residue upon coupling. Preferred as a DIR coupler releasing a development restrainer are the compounds described in the patents abstracted in above RD 17643, VII-F, JP-A-57-151944, JP-A-57-154234 and JP-A-60-184248, and U.S. Pat. No. 4,248,962. Preferred as a coupler releasing imagewise a nucleus-forming agent or a development accelerator during development are the couplers described in, for example, British Patents 2,097,140 and 2,131,188, and JP-A-59-157638 and JP-A-59-170840.

In addition to the above compounds, the couplers which may be used in the light-sensitive material of the present invention include the competitive couplers described in U.S. Pat. No. 4,130,427; the polyequivalent couplers described in U.S. Pat. Nos. 4,283,472, 4,338,393 and 4,310,618; the DIR redox couplers or DIR coupler releasing couplers described in JP-A-60-185950 and JP-A-62-24252; the couplers releasing a dye whose color is recovered after releasing, described in European Patent 173,302A; the bleaching accelerator-releasing couplers described in RD Nos. 11449 and 24241, and JP-A-61-201247; and the ligand-releasing couplers described in U.S. Pat. No. 4,553,477.

The couplers used in the present invention can be incorporated into the light-sensitive material by various conventional dispersing methods.

Examples of a high boiling-solvent used in an oil-in-water dispersion method are described in U.S. Pat. No. 2,322,027. Representative examples of the high-boiling organic solvent which has a boiling point of 175° C. or higher under atmospheric pressure and is used in the oil-in-water dispersion method include phthalic esters (for example, dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1-diethylpropyl) phthalate), phosphoric acid or phosphonic acid esters (for example, triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexyl phosphate), benzoic acid esters (for example, 2-ethylhexyl benzoate, dodecyl benzoate, and 2-ethylhexyl p-hydroxybenzoate), amides (for example, N,N-diethyldodecanamide, N,N-diethyllaurylamide, and N-tetradecylpyrrolidone), alcohols or phenols (for example, isostearyl alcohol and 2,4-di-tert-amylphenol), aliphatic carboxylic acid esters (for example, bis(2-ethylhexyl) sebacate, dioctyl azelate, glycerol tributylate, isostearyl lactate, and trioctyl citrate), aniline derivatives (for example, N,N-dibutyl-2-butoxy-5-tert-octylaniline), and hydrocarbons (for example, paraffin, dodecylbenzene, and diisopropylnaphthalene).

Also, there can be used as an auxiliary solvent, an organic solvent having a boiling point of about 30° C. or higher, preferably 50° C. or higher and about 160° C. or lower. Typical examples thereof include ethyl acetate, butyl acetate, ethyl propionate, methyl ethyl ketone, cyclohexanone, 2-ethoxyethyl acetate, and dimethylformamide.

The steps and effects of a latex dispersing method and latexes for impregnation are described in U.S. Pat. No. 4,199,363, and German Patents (OLS) Nos. 2,541,274 and 2,541,230.

In the photographic light-sensitive material of the present invention, the photographic emulsion layers and other layers are coated on a flexible support such as a plastic film, paper and cloth, or a rigid support such as glass, ceramics and metal, each of which is commonly used for a photographic light-sensitive material. The flexible support may be a film made of a semi-synthetic or synthetic polymer such as cellulose nitrate, cellulose acetate, cellulose acetate butyrate, polystyrene, polyvinyl chloride, polyethylene terephthalate, and polycarbonate, or it may be paper coated or laminated with a baryta layer or an α-olefin polymer (for example, polyethylene, polypropylene, and an ethylene/butene copolymer). The support may be colored with a dye or a pigment. It may be colored to black for the purpose of light shielding. In general, the surfaces of these supports are subjected to a subbing treatment in order to improve the adhesion thereof with a photographic emulsion layer. The surface of the support may be subjected to a glow discharge treatment, a corona discharge treatment, an ultraviolet irradiation treatment or a flame treatment.

To coat the hydrophilic colloid layers such as a photographic emulsion layer and the others, one may use various publicly known coating methods such as a dip coating method, a roller coating method, a curtain coating method and an extrusion coating method. Multilayers may be simultaneously coated according to the coating methods described in U.S. Pat. Nos. 2,681,294, 2,761,791, 3,526,528 and 3,508,947, according to necessity.

The present invention can be used as various color and black-and-white light-sensitive materials. Representative examples include a color negative film for general purposes or a movie, a color reversal film for a slide or a television, a color paper, a color positive film, a color reversal film, a color diffusion transfer type light-sensitive material, and a heat development type color light-sensitive material. The three color coupler mixture described in *Research Disclosure* No. 17123 (July 1978) and the black color developing couplers described in U.S. Pat. No. 4,126,461 and British Patent 2,102,136 can be utilized in the present invention to create a black-and-white light-sensitive material such as an X-ray film. The present invention can be a photomechanical film, such as a lith film and a scanner film, an X-ray film for indirect and direct medical services or industrial uses, a negative black-and-white film for photographing, a black-and-white photographic paper, a micro film for COM or general use, a silver salt diffusion transfer type light-sensitive material, or a printout type light-sensitive material.

When the photographic elements of the present invention are used in a color diffusion transfer photographic method, one can use the constitution of a peel apart type film unit, the integrated type film unit described in JP-B-46-16356 and JP-B-48-33697, JP-A-50-13040, and British Patent 1,330,524, or the non-peeling type film unit described in JP-A-57-119345. .

In either of the above types of formats, it is advantageous in expanding the allowable range of the processing temperature to apply a polymer acid layer protected by a neutralization timing layer. Also, when they are used in a color diffusion transfer photographic method, they may be added to any of the layers in the light-sensitive material, or may be sealed in a processing solution vessel for use as a development solution component.

Various exposing means can be applied to the light-sensitive material of the present invention. A light source radiating a radiant ray corresponding to a wavelength to which a light-sensitive material is sensitive can be used as a light source for illumination or writing. Natural light (sun light), an incandescent lamp, a halogen atom-charged lamp, a mercury vapor lamp, a fluorescent lamp, and a flash light source such as an electric flash and a metal-burning valve are commonly used.

One can use as a light source for recording, lasers of gas, a dye solution and a semiconductor, emitting diode, and a plasma light source, which emit light in a wavelength ranging from ultraviolet to infrared. Further, one can also use a fluorescent display (CRT) from which light is emitted with a phosphor activated by an electron beam and an X ray, or an exposure means in which a linear or planar light source is combined with a micro shutter array utilizing a liquid crystal (LC) and lanthanum-doped lead titanium zirconate (PLZT). The spectral distribution which is used for exposure can be adjusted with a color filter according to necessity.

The color developing solution used for development processing the light-sensitive material of the present invention is preferably an alkaline aqueous solution containing an aromatic primary amine type color developing agent as its primary component. An aminophenol compound is also useful as the color developing agent, but a p-phenylenediamine compound is preferably used. Representative examples thereof include, 3-methyl-4-amino-N,N-diethylaniline, 3-methyl-4-amino-N-ethyl-N-β-hydroxyethylaniline, 3-methyl-4-amino-N-ethyl-β-methanesulfonamidoethylaniline, 3-methyl-4-amino-N-ethyl-N-β-methoxyethylaniline, and sulfates, hydrochlorides and p-toluenesulfonates thereof. The salts of these diamines rather than the free compounds are preferably used because the salts are generally more stable than the free compounds.

In general, the color developing solution contains a pH buffer agent such as a carbonate, borate or phosphate of alkali metals, and a development inhibitor or an anti-foggant such as bromide, iodide, benzimidazoles, benzothiazole, and mercapto compounds. Further, there may be added to the color developing solution according to necessity, a preservative such as hydroxylamine and sulfite, an organic solvent such as triethanolamine and diethylene glycol, a development accelerator such as benzyl alcohol, polyethylene glycol, a quaternary ammonium salt and amines, a dye-forming coupler, a competitive coupler, a nucleus-forming agent such as sodium boron hydride, an auxiliary developing agent such as 1-phenyl-3-pyrazolidone, a tackifier, various chelating agents represented by aminopolycarboxylic acid, aminopolyphosphonic acid, alkylphosphonic acid, and phosphonocarboxylic acid, and the anti-oxidation agents described in German Patent (OLS) No. 2,622,950.

In development processing a reversal color light-sensitive material, color development is usually carried out after black-and-white development. One can use singly or in combination as the developing solution for this black-and-white development, the commonly known black-and-white developing agents such as dihydroxybenzenes including hydroquinone, 3-pyrazolidones including 1-phenyl-3-pyrazolidone, and aminophenols including N-methyl-p-aminophenol.

A photographic emulsion layer is usually subjected to a bleaching treatment after color development. The bleaching treatment may be carried out at the same time as a fixing treatment or may be independently carried out. Further, one may use a processing method in which a bleach-fixing treatment is carried out after the bleaching treatment in order to accelerate processing. The bleaching agent may be, for example, the compounds of polyvalent metals such as iron(III), cobalt(III), chromium(IV) and copper(II), peracids, quinones, and nitrons. Representative bleaching agents include: a ferricyanide compound; bichromate; an organic complex salt of iron(III) or cobalt(III), for example, the complex salts of aminopolycarboxylic acids such as ethylenediaminetetraacetic acid, diethylenetriaminepentaacetic acid, nitrilotriacetic acid, and 1,3-diamino-2-propanoltetraacetic acid, and the complex salts of the organic acids such as citric acid, tartaric acid and malic acid; persulfates; manganates; and nitrosophenols. Among them, preferred from the viewpoint of rapid processing and environmental pollution are iron(III) ethylenediaminetetraacetate, iron(III) diethylenetriaminepentaacetate, and persulfate. Further, iron(III) ethylenediaminetetraacetate is particularly useful either for an independent bleaching solution or a single bleach-fixing bath.

A bleaching accelerator can be used in a bleaching bath, a bleach-fixing bath and a pre-bath thereof according to necessity. Examples of suitable bleaching accelerators include: the compounds having a mercapto group or a disulfide group described in U.S. Pat. No. 3,893,858, German Patents 1,290,812 and 2,059,988, JP-A-53-32736, JP-A-53-57831, JP-A-53-37418, JP-A-53-65732, JP-A-53-72623, JP-A-53-95630, JP-A-53-95631, JP-A-53-104232, JP-A-53-124424, JP-A-53-141623, and JP-A-53-28426, and *Research Disclosure* No. 17129 (July 1978); the thiazolidine derivatives described in JP-A-50-140129; the thiourea derivatives described in JP-B-45-8506, JP-A-52-20832 and JP-A-53-32735, and U.S. Pat. No. 3,706,561; the iodides described in German Patent 1,127,715 and JP-A-58-16235; the polyethylene oxides described in German Patents 966,410 and 2,748,430; the polyamine compounds described in JP-B-45-8836; and the compounds described in JP-A-49-42434, JP-A-49-59644, JP-A-53-94927, JP-A-54-35727, JP-A-55-26506, and JP-A-58-163940. An iodine ion and a bromine ion can also be used. Among them, the compounds having a mercapto group or a disulfide group are preferred from the viewpoint of a larger bleaching acceleration effect. Particularly preferred are the compounds described in U.S. Pat. No. 3,893,858, German Patent 1,290,812, and JP-A-53-95630. The compounds described in U.S. Pat. No. 4,552,834 are also preferred. These bleaching accelerators may be incorporated into a light-sensitive material. These bleaching accelerators are particularly useful when the color light-sensitive material for photographing is bleached and fixed.

The fixing agents include thiosulfates, thiocyanates, thioether compounds, thioureas, and large amounts of iodides. Of them, thiosulfates are generally used. Sulfites, bisulfites and carbonyl bisulfites adducts are preferred as a preservative for a bleach-fixing solution and a fixing solution.

After a bleach-fixing treatment or a fixing treatment, a washing treatment and a stabilizing treatment are usually carried out. In a washing step and a stabilizing step, various known compounds may be used for the purpose of preventing precipitation and saving water. If necessary, one can add to prevent precipitation, for example, a water softening agent such as inorganic phosphoric acid, aminopolycarboxylic acid, organic aminopolyphosphonic acid, and organic phosphoric acid; a fungicide and an anti-mold agent to prevent the generation of various bacteria, algae and molds; metal salts represented by a magnesium salt, an aluminum salt and a bismuth salt; a surface active agent to prevent a drying load and unevenness; and various hardeners. Also, there may be added the compounds described in *Photographic Science and Engineering*, Vol. 6, pp. 344 to 359 (1965), written by L. E. West. Particularly, a chelating agent and an anti-mold agent are advantageously added.

The washing step is generally carried out by a countercurrent washing in two or more baths to save water. Further, the washing step may be replaced by a multistage countercurrent stabilizing treatment step as described in JP-A-57-8543. In this step, 2 to 9 countercurrent baths are needed.

In addition to the above additives, various compounds are added to the stabilizing bath for the purpose of stabilizing the image. Representative examples thereof include various buffer agents for adjusting layer pH (for example, pH 3 to 9) (there can be used in combination, for example, borates, metaborates, borax, phosphates, carbonates, potassium hydroxide, sodium hydroxide, aqueous ammonia, monocarboxylic acid, dicarboxylic acid, and polycarboxylic acid), and aldehydes such as formaldehyde. Additionally, according to necessity, one may use a chelating agent (for example, inorganic phosphoric acid, aminopolycarboxylic acid, organic phosphoric acid, organic phosphonic acid, aminopolyphosphonic acid, and phosphonocarboxylic acid), a fungicide (for example, benzoisothiazolinone, isothiazolone, 4-thiazolinebenzimidazole, halogenated phenol, sulfanylamide, and benzotriazole), a surface active agent, a fluorescent whitening agent, and a hardener. Two or more kinds of compounds added for the same or different purposes may be used in combination.

Further, preferably added as a layer pH adjusting agent after processing are various ammonium salts such as ammonium chloride, ammonium nitrate, ammonium sulfate, ammonium phosphate, ammonium sulfite, and ammonium thiosulfate.

In a light-sensitive material for photographing, conventional steps after fixing (washing and stabilizing) can be replaced by the above stabilizing and washing steps (water saving processing). In this case, if a magenta coupler is two-equivalent, the formaldehyde contained in a stabilizing bath may be removed.

In the present invention, washing and stabilizing time is adjustable according to the kind of a light-sensitive material and the processing conditions. It is usually 20 seconds to 10 minutes, preferably 20 seconds to 5 minutes.

The silver halide color light-sensitive material of the present invention may be incorporated with a color developing agent for the purpose of simplifying and accelerating processing. Various precursors of the color developing agents are preferably used in order to incorporate them into the light-sensitive material. One can use, for example, the various salt type precursors described in JP-A-56-6235, JP-A-56-16133, JP-A-56-59232, JP-A-56-67842, JP-A-56-83734, JP-A-56-83735, JP-A-56-83736, JP-A-56-89735, JP-A-56-81837, JP-A-56-54430, JP-A-56-106241, JP-A-56-107236, JP-A-57-97531, and JP-A-57 -83565, as well as the indoaniline compounds described in U:S. Pat. No. 3,342,597, the Schiff base type compounds described in U.S. Pat. No. 3,342,599 and *Research Disclosure* Nos. 14850 and 15159, the aldol compounds described in *Research Disclosure* No. 13924, the metal salt complexes described in U.S. Pat. No. 3,719,492, and the urethane compounds described in JP-A-53-135628.

The silver halide color light-sensitive material of the present invention may be incorporated with various 1-phenyl-3-pyrazolidones for the purpose of accelerating color development according to necessity. Typical examples are described in JP-A-56-64339, 57-144547, JP-A-57-211147, JP-A-58-50532, JP-A-58-50536, JP-A-58-50533, JP-A-58-50534, JP-A-58-50535, and JP-A-58-115438.

In the present invention, various processing solutions are used at 10° to 50° C. The temperature of 33° to 38° C. is standard. However, the temperature can be set higher to accelerate the processing to shorten processing time. Or on the contrary, the temperature can be set lower to increase the image quality and improve the stability of the processing solution. Further, in order to save silver contained in a light-sensitive material, one may carry out the processing in which a cobalt intensification or a hydrogen peroxide intensification is used, as described in German Patent 2,226,770 and U.S. Pat. No. 3,674,499.

Various processing baths may be provided with a heater, a temperature sensor, a liquid level sensor, a circulating pump, a filter, a floating lid and a squeezer according to necessity.

In continuous processing, variations of the composition of the processing solutions can be prevented by using replenishing solutions for the respective processing solutions to achieve a uniform finishing. The replenishing amounts can be reduced to a half or lower of the standard replenishing amount for cost saving.

When the light-sensitive material is a color paper, it is subjected to a very conventional bleach-fixing treatment, and when it is a color photographic material for photographing, it is subjected to the bleach-fixing treatment according to necessity.

The present invention will be concretely shown in the following non-limiting examples.

EXAMPLE 1

A silver nitrate aqueous solution and a potassium bromide aqueous solution were added to a gelatin aqueous solution containing potassium bromide and ammonia and maintained at 60° C. by a double jet method while maintaining the silver potential at +20 mV against a saturated calomel electrode.

After finishing the formation of the grains, desalting was carried out by a flocculation method and gelatin was added, followed by adjusting pH and pAg to 6.3 and 8.5, respectively.

This silver bromide emulsion was a monodispersed tetradecahedron emulsion having an average grain size of 0.85 μm, a (111)/(100) face ratio of 55/45, and a variation coefficient of the grain size of 12%.

This emulsion was divided into seven samples. The respective samples were heated to 60° C., and sensitizing agents were added thereto as shown in Table 4 to provide a chemical ripening. A part of each sample was taken out at the intervals as shown in Table 4. Then, the following compounds were added thereto to prepare coating solutions, which were then applied on a triacetyl cellulose support together with a protective layer by a simultaneous extrusion method. (1) Emulsion layer:

(a) Emulsion—as shown in Table 4.

(b) Coupler

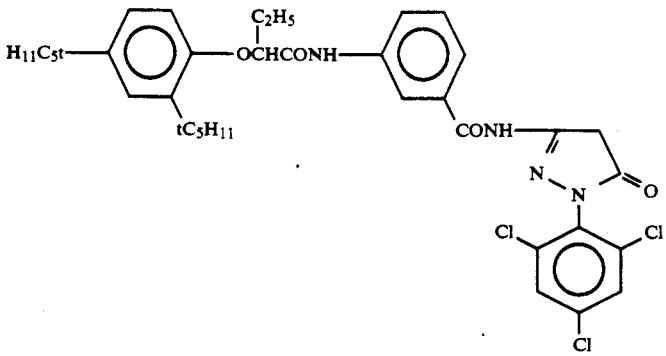

(c) Tricresyl phosphate, (d) Stabilizer—4-hydroxy-6-methyl-1,3,3a,7-tetraazaindene, (e) Coating aid—sodium dodecylbenzenesulfonate.

(2) Protective layer:

(a) Polymethyl methacrylate fine particles, (b) Sodium 2,4-dichloro-6-hydroxy-s-triazine, (c) Gelatin.

These samples were subjected to exposure (1/100 second) for sensitometry and then to the following color development processing.

The processed samples were subjected to a density measurement through a green filter. The results of the photographic performances thus obtained are shown in Table 4.

Relative sensitivity is defined by the reciprocal of the exposure necessary to obtain an optical density of fog+0.2 and is expressed by a value relative to that of Sample 101 at a ripening time of 60 minutes, which was set at 100.

The development processing used herein was carried out at 38° C. as shown below:

| | |
|---|---|
| 1. Color developing | 2 minutes and 45 seconds |
| 2. Bleaching | 6 minutes and 30 seconds |
| 3. Rinsing | 3 minutes and 15 seconds |
| 4. Fixing | 6 minutes and 30 seconds |
| 5. Rinsing | 3 minutes and 15 seconds |
| 6. Stabilizing | 3 minutes and 15 seconds |

The compositions of the processing solutions used in the respective steps are shown as follows:

| | |
|---|---|
| Color developing solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-Ethyl-N-β-hydroxyethylamino)-2-methylaniline sulfate | 4.5 g |
| Water to make | 1 liter |
| Bleaching solution: | |
| Ammonium bromide | 160.0 g |
| Aqueous ammonia (28%) | 25.0 ml |
| Sodium ethylenediaminetetraacetate | 130 g |
| Glacial acetic acid | 14 ml |
| Water to make | 1 liter |
| Fixing solution: | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 liter |
| Stabilizing solution: | |

-continued

| | |
|---|---|
| Formalin | 8.0 ml |
| Water to make | 1 liter |

TABLE 4

| Sample No. | Compound (Add. amount. mol/mol AgX) | Chemical ripening 40 min. Fog | 40 min. S*1 | 60 min. Fog | 60 min. S*1 | 80 min. Fog | 80 min. S*1 |
|---|---|---|---|---|---|---|---|
| 101 (Comp.) | A (Comp.) ($4 \times 10^{-6}$) | 0.24 | 85 | 0.26 | 100 | 0.30 | 91 |
| 102 (Comp.) | B (Comp.) ($6.5 \times 10^{-6}$) | 0.10 | 68 | 0.16 | 106 | 0.31 | 83 |
| 103 (Inv.) | 5 ($3 \times 10^{-6}$) | 0.14 | 83 | 0.18 | 100 | 0.25 | 94 |
| 104 (Inv.) | 7 ($4 \times 10^{-6}$) | 0.12 | 88 | 0.18 | 104 | 0.26 | 98 |
| 105 (Inv.) | 9 ($4 \times 10^{-6}$) | 0.15 | 90 | 0.18 | 102 | 0.24 | 95 |
| 106 (Inv.) | 13 ($3 \times 10^{-6}$) | 0.12 | 88 | 0.15 | 100 | 0.24 | 90 |
| 107 (Inv.) | 14 ($3 \times 10^{-6}$) | 0.12 | 85 | 0.16 | 96 | 0.22 | 90 |

Comparative Compound A: N,N-dimethylselenourea. (compound described in U.S. Pat. No. 3,297,447)

Comparative Compound B: triphenylphosphine selenide. (compound described in U.S. Pat. No. 3,297,447)

*1Relative sensitivity.

As is apparent from the results shown in Table 4, Comparative Compound A conventionally known as a selenium sensitizer provides high fog while giving a relatively low sensitivity change resulting from the change in chemical ripening time. Meanwhile, Comparative Compound B provides a large fluctuation in fog and sensitivity resulting from the change of the chemical ripening time while giving a low fog at an optimum chemical ripening time.

Clearly preferable results were obtained with the compounds of the present invention in that they provide low fog and a small fluctuation in sensitivity and fog resulting from the change in chemical ripening time.

Further, a lower addition amount of the compounds of Formula (I) than that of the Comparative Compound B provided a higher sensitivity and a lower fog than those with Comparative Compound B. This is the preferred result for the stable production of a light-sensitive material.

EXAMPLE 2

To a reaction vessel containing 1.2 liters of a 3.0 weight % gelatin solution including 0.06 mole of potassium bromide and maintained at 75° C. were added 30 ml of a 25 weight % aqueous ammonia wile stirring. Then 50 ml of an aqueous solution containing 0.3 mole of silver nitrate and 50 ml of a halide aqueous solution containing 0.63 mole of potassium iodide and 0.19 mole of potassium bromide were added thereto by a double jet method over a period of 3 minutes, whereby silver bromoiodide grains having a projected area-corresponding circle diameter of 0.2 μm and a silver iodide content of 25 mole % were obtained to form a nucleus. Subsequently, 60 ml of an aqueous ammonia was added similarly at 75° C. Then 800 ml of an aqueous solution containing 1.5 mole of silver nitrate and 800 ml of a halide solution containing 0.375 mole of potassium iodide and 1.13 mole of potassium bromide were simultaneously added by a double jet method over a period of 80 minutes, whereby the first coating layer was formed. The emulsion thus obtained comprised octahedral silver bromoiodide grains having a projected area-corresponding circle diameter of 0.95 μm (silver iodide content: 25 mole %).

Next, acetic acid was added for neutralization, and then a silver nitrate solution of 1.5 mole, a potassium bromide solution of 1.5 mole and a 2 weight % gelatin solution were added to the reaction vessel to form a silver bromide shell (the second coating layer). Silver halide grains having a first coating layer/second coating layer ratio of 1:1 were obtained. The grains thus obtained were octahedral monodispersed core/shell grains having a projected area-corresponding circle diameter of 1.2 μm.

The emulsion thus obtained was divided into five samples, and each sample was heated to 56° C. Next, the following Sensitizing Dyes I to III were added and then the sensitizers shown in Table 5 were added. Further, added were a sodium thiosulfate ($6\times10^{-6}$ mole/mole of AgX) aqueous solution, a chloroauric acid ($1.2\times10^{-5}$ mole/mole of AgX) solution and a potassium thiocyanate ($4.0\times10^{-4}$ mole/mole of AgX) aqueous solution to provide ripening. A part of each of the respective samples were taken out in the course of ripening, and then there was added an emulsion containing a coating aid (sodium dodecyclbenzenesulfonate), a stabilizer (4-hydroxy-6-methyl-1,3,3a,7-tetraazaindene), an anti-foggant (monosodium 1-m-sulfophenyl)-5-mercaptotetrazole), Oil-1 and Oil-2, and Coupler-1 to Coupler-4, whereby a coating solution was prepared. The coating solution thus prepared and a protective layer coating solution (containing gelatin, polymethyl methacrylate grains, H-1, S-1, and S-2) were applied on a triacetyl cellulose support having a subbing layer by a simultaneous extrusion method.

Sensitizing Dye I:

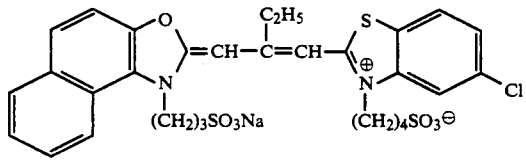

Sensitizing Dye II:

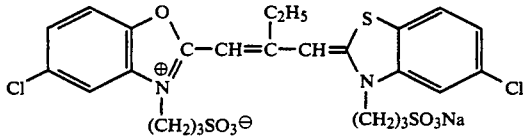

Sensitizing Dye III:

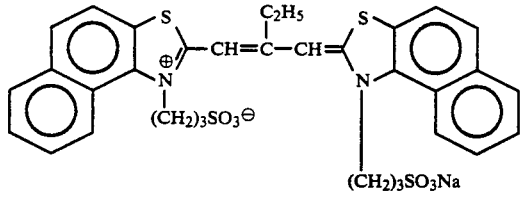

Oil-1: tricresyl phosphate

Oil-2: bis(2-ethylhexyl)phthalate

Coupler-1:

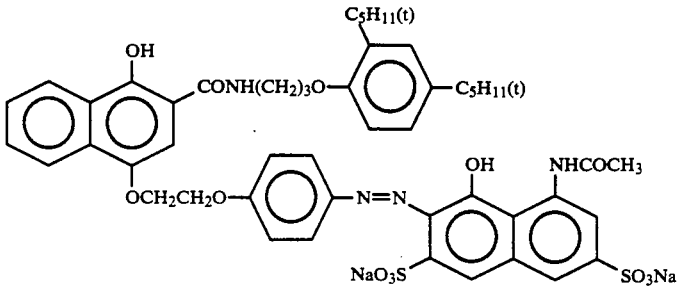

-continued

Coupler-2:

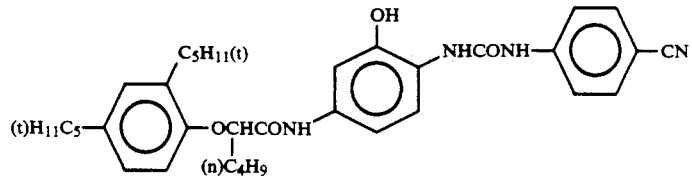

Coupler-3:

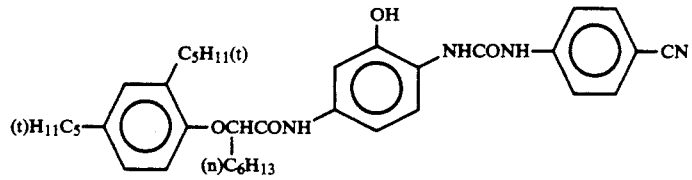

Coupler-4:

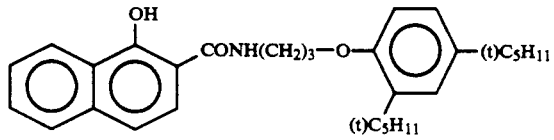

H-1:

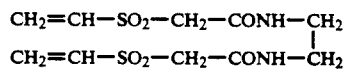

S-1:

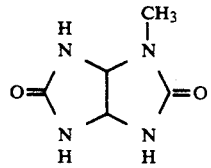

S-2:

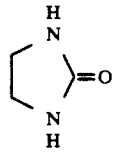

These samples were subjected to an exposure (1/100 second) via a yellow filter and then to a color development processing in the same manner as in Example 1.

The processed samples were subjected to a density measurement through a red filter to obtain the results shown in Table 5.

TABLE 5

| Sample No. | Compound (Add. amount. mol/mol AgX) | Chemical ripening 46 min. Fog | 46 min. S*1 | 56 min. Fog | 56 min. S*1 | 66 min. Fog | 66 min. S*1 |
|---|---|---|---|---|---|---|---|
| 201 (Comp.) | A (Comp.) ($1.5 \times 10^{-6}$) | 0.30 | 84 | 0.36 | 100 | 0.48 | 89 |
| 202 (Comp.) | B (Comp.) ($2.3 \times 10^{-6}$) | 0.16 | 75 | 0.21 | 104 | 0.42 | 85 |
| 203 (Inv.) | 4 ($1.5 \times 10^{-6}$) | 0.18 | 87 | 0.24 | 98 | 0.30 | 90 |
| 204 (Inv.) | 11 ($2 \times 10^{-6}$) | 0.15 | 90 | 0.22 | 102 | 0.28 | 92 |
| 205 (Inv.) | 13 ($1.5 \times 10^{-6}$) | 0.14 | 85 | 0.22 | 100 | 0.28 | 89 |

Comparative Compounds A and B are the same as in Example 1.
*1Relative sensitivity.

Relative sensitivity is expressed by a value relative to that of Sample 201 containing the silver halide emulsion subjected to a chemical ripening for 56 minutes, which was set at 100.

As is apparent from the results shown in Table 5, when a gold-sulfur-selenium sensitization is provided, the conventional Comparative Compound A gives a high fog while providing moderate chemical ripening. Meanwhile, Comparative Compound B gives a rapid chemical ripening while providing low fog. On the contrary, preferable results were obtained with the compounds of the present invention that they provide low fog as well as moderate chemical ripening.

EXAMPLE 3

To a solution in which potassium bromide, thioether $[HO(CH_2)_2S(CH_2)_2S(CH_2)_2OH]$ and gelatin were dissolved and which was maintained at 70° C., a silver nitrate aqueous solution and a mixed aqueous solution containing potassium iodide, potassium bromide and $K_3IrCl_6$ ($3 \times 10^{-6}$ mole/mole of Ag) were added by a double jet method while stirring.

After finishing the addition, the temperature of the emulsion was lowered to 35° C. and then the soluble salts of the emulsion were removed by a conventional flocculation method. Then, the temperature thereof was raised once again to 40° C. and 60 g of gelatin were added, followed by adjusting pH to 6.8.

The tabular silver halide grains thus obtained had an average diameter of 1.25 μm, a thickness of 0.17 μm, an average diameter/thickness ratio of 7.4, and a silver iodide content of 3 mole %. Also, the pAg was 8.4 at 40° C.

This emulsion was divided into five samples which were heated to 62° C. Then, there were added thereto, a sensitizing dye sodium anhydro-5,5'-dichloro-9-ethyl-3,3'-di(3-sulfopropyl)oxacarbocyanine hydroxide (500 mg/mole of AgX), potassium iodide (200 mg/mole of AgX) and a sensitizing agent as shown in Table 6. Also added were a chloroauric acid ($9\times10^6$ mole/mole of AgX) aqueous solution, a potassium thiocyanate ($3.2\times10^{-4}$ mole/mole of AgX) aqueous solution, and a sodium thiosulfate ($8\times10^{-6}$ mole/mole of AgX) aqueous solution, to chemically ripen the emulsion for 30 minutes.

After the chemical sensitization, each 100 g (containing 0.08 mole of Ag) of the respective emulsions was heated to 40° C., and then the following compounds (1) to (4) were added in consecutive order while stirring to prepare an emulsion layer coating solution:

| | | | |
|---|---|---|---|
| (1) | 4-Hydroxy-6-methyl-1,3,3a,7-tetraazaindene | 3% | 2 ml |
| (2) | $C_{17}H_{35}$—O—$(CH_2CHO)_{25}$—H | 2% | 2.2 ml |
| (3) | Poly(potassium styrenesulfonate) (polymerization degree: about 3000) | 2% | 1.6 ml |
| (4) | Sodium 2,4-dichloro-hydroxy-s-triazine | 2% | 3 ml |

The following compounds (1) to (5) were added in consecutive order while stirring to prepare a surface protective layer coating solution:

| | | | |
|---|---|---|---|
| (1) | 14% gelatin aqueous solution | | 56.8 g |
| (2) | Polymethyl metacrylate fine particles (average particle size: 3.0 μm) | | 3.9 g |
| (3) | Emulsion | | |
| | Gelatin | 10% | 4.24 g |
| | $NaO_3S$—$CH(CH_2COOCH_2CH(C_2H_5)C_4H_9)$—$COOCH_2CH(C_2H_5)C_4H_9$ | | 10.6 mg |
| | Phenoxy ethanol | | 0.02 g |
| | 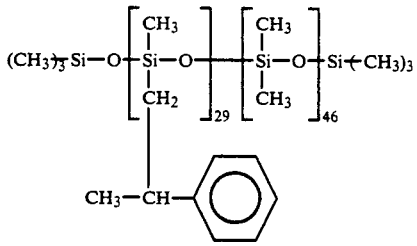 | | 0.424 g |
| (4) | Water | | 68.8 ml |
| (5) | $C_8H_{17}$—$C_6H_5(OCH_2CH_2)_2CH_2CH_2SO_3Na$ | 4.3% | 3 ml |

The emulsion layer coating solution and surface protective layer coating solution were applied on a polyethylene terephthalate film support by a simultaneous extrusion method so that the volume ratio thereof just after coating was 103:45. The coated amount of silver was 2.5 g/m$^2$.

These samples were subjected to an exposure (1/100 second) via a yellow filter and an optical wedge with a sensitometer. They were then subjected to a development processing in an RD-III developing solution (manufactured by Fuji Photo Film Co., Ltd.) for an automatic processor at 35° C. for 30 seconds, followed by fixing, rinsing and drying in a conventional manner, to measure a photographic sensitivity. The samples were left to stand under a temperature of 50° C. and a relative humidity of 80% for 2 days and then subjected to development processing. Photographic sensitivity is defined by the reciprocal of an exposure necessary to give an optical density of fog+0.2 and expressed by a value relative to that of Sample 301 just after coating, which was set at 100. The results are shown in Table 6.

TABLE 6

| Sample No. | Compound (Add. amount. mol/mol AgX) | Just after coating Fog | Just after coating S*1 | After*2 Storage S*1 |
|---|---|---|---|---|
| 301 (Comp.) | A (Comp.) ($1.5\times10^{-6}$) | 0.30 | 100 | 79 |
| 302 (Comp.) | B (Comp.) ($2.5\times10^{-6}$) | 0.19 | 104 | 73 |
| 303 (Inv.) | 3 ($1.0\times10^{-6}$) | 0.22 | 96 | 82 |
| 304 (Inv.) | 13 ($1.5\times10^{-6}$) | 0.20 | 100 | 85 |
| 305 (Inv.) | 17 ($1.5\times10^{-6}$) | 0.21 | 102 | 87 |

Comparative Compounds A and B are the same as in Example 1.
*1Relative sensitivity.
*2At 50° C. and 80% RH for 2 days.

As is apparent from the results shown in Table 6, preferable results are obtained in that the compounds of the present invention provide less fog compared with the conventional Comparative Compound A and that they provide fog at the same level as that of the Comparative Compound B while providing less degradation of sensitivity after storage under high temperature and humidity conditions.

EXAMPLE 4

An emulsion prepared in the same manner as in Example 1 was divided into seven samples. The respective samples were heated to 60° C., and then the sensitizers were added thereto as shown in Table 7 to provide chemical ripening for 60 minutes. Thereafter, the coated samples were prepared in the same manner as in Example 1 and subjected to an exposure and development processing in the same manner as in Example 1.

The processed samples were subjected to measurement of density through a green filter. The results of the photographic performances obtained are shown in Table 7.

Further, after the respective samples were left to stand under a temperature of 45° C. and a relative humidity of 80% for 5 days, they were similarly subjected to an exposure and development processing. Relative sensitivity is defined by the reciprocal of the exposure necessary to give an optical density of fog +0.2 and expressed by a value relative to that of Sample 401 just after coating, which was set at 100. The results are show in Table 7.

TABLE 7

| Sample No. | Compound (Add. amount. mol/mol AgX) | Just after coating Fog | Just after coating S*1 | After*2 Storage S*1 |
|---|---|---|---|---|
| 401 (Comp.) | A (Comp.) ($4\times10^{-6}$) | 0.26 | 100 | 71 |
| 402 (Comp.) | B (Comp.) ($6.5\times10^{-6}$) | 0.16 | 106 | 68 |
| 403 (Inv.) | 41 ($6.5\times10^{-6}$) | 0.16 | 100 | 82 |
| 404 (Inv.) | 46 ($6.5\times10^{-6}$) | 0.14 | 96 | 78 |
| 405 (Inv.) | 49 ($3\times10^{-6}$) | 0.18 | 102 | 88 |
| 406 (Inv.) | 50 | 0.18 | 100 | 85 |

TABLE 7-continued

| Sample No. | Compound (Add. amount. mol/mol AgX) | Just after coating Fog | Just after coating S*1 | After*2 Storage S*1 |
|---|---|---|---|---|
| | ($3 \times 10^{-6}$) | | | |
| 407 (Inv.) | 55 ($3 \times 10^{-6}$) | 0.16 | 104 | 90 |

Comparative Compounds A and B are the same as in Example 1.
*1Relative sensitivity.
*2At 45° C. and 80% RH for 5 days.

As is apparent from the results shown in Table 7, Comparative Compound A which is known as a selenium sensitizer provides a high fog. Meanwhile, Comparative Compound B has the drawback that sensitivity degradation after storage under high temperature and humidity is a little larger than that of Comparative Compound A while giving a low fog.

On the contrary, preferable results are obtained with the compounds of the present invention in that they provide a low fog and less sensitivity deterioration after storage under high temperature and humidity conditions.

EXAMPLE 5

The samples were prepared in the same manner as in Example 2 and subjected to color development processing in the same manner as in Example 1. The processed samples were subjected to measurement of density through a red filter. The results are shown in Table 8.

Relative sensitivity is the value relative to that of Sample 405 containing the emulsion subjected to chemical ripening for 56 minutes, which was set at 100.

TABLE 8

| Sample No. | Compound (Add. amount. mol/mol AgX) | Chemical ripening 46 min. Fog | 46 min. S*1 | 56 min. Fog | 56 min. S*1 | 66 min. Fog | 66 min. S*1 |
|---|---|---|---|---|---|---|---|
| 501 (Comp.) | A (Comp.) ($1.5 \times 10^{-6}$) | 0.30 | 84 | 0.36 | 100 | 0.48 | 89 |
| 502 (Comp.) | B (Comp.) ($2.3 \times 10^{-6}$) | 0.16 | 75 | 0.21 | 104 | 0.42 | 85 |
| 503 (Inv.) | 48 ($3 \times 10^{-6}$) | 0.18 | 82 | 0.22 | 96 | 0.28 | 87 |
| 504 (Inv.) | 50 ($1.5 \times 10^{-6}$) | 0.20 | 88 | 0.25 | 100 | 0.32 | 89 |
| 505 (Inv.) | 55 ($1.5 \times 10^{-6}$) | 0.16 | 87 | 0.22 | 102 | 0.30 | 84 |

Comparative Compounds A and B are the same as Example 1.
*1Relative sensitivity.

As is apparent from the results shown in Table 8, when a gold-sulfur-selenium sensitization is provided, conventional Comparative Compound A gives high fog while providing a moderate chemical ripening. Meanwhile, Comparative Compound B gives rapid chemical ripening while providing low fog. On the contrary, preferable results are obtained with the compounds of the present invention in that they provide low fog as well as moderate chemical ripening.

EXAMPLE 6

A silver halide emulsion was prepared in the same conditions as in Example 3, and this emulsion was divided into six samples to provide ripening in the same conditions as in Example 3. The coated samples were prepared with these emulsions.

These samples were subjected to an exposure (1/100 second) via a yellow filter and an optical wedge with a sensitometer. They were then subjected to development processing in an RD-III developing solution (manufactured by Fuji Photo Film Co., Ltd.) in an automatic processor at 35° C. for 30 seconds, followed by fixing, rinsing and drying in a conventional manner, to measure photographic sensitivity. Further, after the samples were left to stand under a temperature of 50° C. and a relative humidity of 80% for 2 days, they were subjected to development processing. Photographic sensitivity is defined by the reciprocal of the exposure necessary to give an optical density of fog +0.2 and expressed by a value relative to that of Sample 601 just after coating, which was set at 100. The results are shown in Table 9.

TABLE 9

| Sample No. | Compound (Add. amount. mol/mol AgX) | Just after coating Fog | Just after coating S*1 | After*2 Storage S*1 |
|---|---|---|---|---|
| 601 (Comp.) | A (Comp.) ($1.5 \times 10^{-6}$) | 0.30 | 100 | 79 |
| 602 (Comp.) | B (Comp.) ($2.5 \times 10^{-6}$) | 0.19 | 104 | 73 |
| 603 (Inv.) | 43 ($2.5 \times 10^{-6}$) | 0.18 | 100 | 85 |
| 604 (Inv.) | 52 ($3.5 \times 10^{-6}$) | 0.21 | 97 | 88 |
| 605 (Inv.) | 53 ($2.5 \times 10^{-6}$) | 0.20 | 100 | 90 |
| 606 (Inv.) | 55 ($1.5 \times 10^{-6}$) | 0.22 | 104 | 90 |

Comparative Compounds A and B are the same as in Example 1.
*1Relative sensitivity.
*2At 50° C. and 80% RH for 2 days.

As is apparent form the results shown in Table 9, preferable results are obtained in that the compounds of the present invention provide less fog compared with conventionally Comparative Compound A and that they provide less degradation of sensitivity after storage under high temperature and humidity conditions compared with Comparative Compound B while providing fog of the same level.

EXAMPLE 7

An emulsion prepared in the same manner as in Example 1 was divided into 16 samples. The respective samples were heated to 60° C., and then sensitizers were added thereto as shown in Table 10 to provide optimum chemical ripening. Thereafter, the coated samples were prepared in the same manner as in Example 1 and subjected to an exposure and color development processing in the same manner as in Example 1.

The processed samples were subjected to measurement of density through a green filter. The results of the photographic performances obtained are shown in Table 10.

Further, after the respective samples were left to stand under a temperature of 45° C. and a relative humidity of 80% for 5 days, they were similarly subjected to an exposure and color development processing. Relative sensitivity is defined by the reciprocal of an exposure necessary to give an optical density of fog +0.2 and expressed by a value relative to that of Sample 701 just after coating, which was set at 100. The results are shown in Table 10.

TABLE 10

| Sample No. | Compound (Add. amount. mol/mol AgX) | Just after coating Fog | Just after coating S*1 | After*2 Storage S*1 |
|---|---|---|---|---|
| 701 (Comp.) | A ($4 \times 10^{-6}$) | 0.26 | 100 | 71 |
| 702 (Comp.) | B ($6.5 \times 10^{-6}$) | 0.16 | 106 | 68 |

TABLE 10-continued

| Sample No. | Compound (Add. amount. mol/mol AgX) | Just after coating Fog | Just after coating S*1 | After*2 Storage S*1 |
|---|---|---|---|---|
| 703 (Comp.) | C ($8 \times 10^{-6}$) | 0.24 | 96 | 65 |
| 704 (Inv.) | 102 ($4 \times 10^{-6}$) | 0.18 | 100 | 84 |
| 705 (Inv.) | 106 ($4 \times 10^{-6}$) | 0.16 | 102 | 82 |
| 706 (Inv.) | 107 ($4 \times 10^{-6}$) | 0.19 | 98 | 88 |
| 707 (Inv.) | 109 ($4 \times 10^{-6}$) | 0.15 | 96 | 81 |
| 708 (Inv.) | 203 ($5 \times 10^{-6}$) | 0.16 | 102 | 80 |
| 709 (Inv.) | 208 ($4 \times 10^{-6}$) | 0.17 | 96 | 76 |
| 710 (Inv.) | 211 ($5 \times 10^{-6}$) | 0.16 | 100 | 78 |
| 711 (Inv.) | 213 ($4 \times 10^{-6}$) | 0.18 | 98 | 78 |
| 712 (Inv.) | 214 ($4 \times 10^{-6}$) | 0.14 | 96 | 76 |
| 713 (Inv.) | 303 ($4 \times 10^{-6}$) | 0.15 | 105 | 81 |
| 714 (Inv.) | 308 ($4 \times 10^{-6}$) | 0.18 | 100 | 75 |
| 715 (Inv.) | 310 ($4 \times 10^{-6}$) | 0.18 | 96 | 74 |
| 716 (Inv.) | 316 ($5 \times 10^{-6}$) | 0.17 | 98 | 78 |

Comparative Compounds A and B are the same as in Example 1.
Comparative Compound C: tri-p-tolylselenophosphate (compound described in U.S. Pat. No. 3,297,447).
*1Relative sensitivity.
*2At 45° C. and 80% RH for 5 days.

As is apparent from the results shown in Table 10, the selenium sensitizers of the present invention provide a lower fog and almost the same final sensitivity in comparison with the conventionally well known selenium sensitizers (A) and (C). In addition, very preferable results were obtained with the compounds of the present invention in that they gave good effect in a lower amount while providing the same level of fog in comparison with the selenium sensitizer (B) which gives a low fog and in that they provide a less degradation of sensitivity after storage under high temperature and humidity conditions.

EXAMPLE 8

The coated samples were prepared in the same manner as in Example 2, except that the emulsion obtained was divided into nine samples and the sensitizers were added as shown in Table 11.

These samples were subjected to an exposure (1/100 second) via a yellow filter and then to color development processing in the same manner as in Example 1.

The processed samples were subjected to density measurement through a red filter to obtain the results shown in Table 11.

TABLE 11

| Sample No. | Compound (Add. amount mol/mol AgX) | Chemical ripening 46 min. Fog | 46 min. S*1 | 56 min. Fog | 56 min. S*1 | 66 min. Fog | 66 min. S*1 |
|---|---|---|---|---|---|---|---|
| 801 (Comp.) | A (Comp.) ($1.5 \times 10^{-6}$) | 0.30 | 84 | 0.36 | 100 | 0.48 | 89 |
| 802 (Comp.) | B (Comp.) ($2.3 \times 10^{-6}$) | 0.16 | 75 | 0.21 | 104 | 0.42 | 85 |
| 803 (Comp.) | C (Comp.) ($3.5 \times 10^{-6}$) | 0.29 | 68 | 0.33 | 98 | 0.45 | 87 |
| 804 (Inv.) | 102 ($1.5 \times 10^{-6}$) | 0.18 | 87 | 0.22 | 102 | 0.30 | 95 |
| 805 (Inv.) | 106 ($1.5 \times 10^{-6}$) | 0.16 | 88 | 0.20 | 100 | 0.28 | 96 |
| 806 (Inv.) | 203 ($2 \times 10^{-6}$) | 0.16 | 91 | 0.22 | 102 | 0.34 | 97 |
| 807 (Inv.) | 214 ($1.5 \times 10^{-6}$) | 0.18 | 86 | 0.24 | 100 | 0.36 | 89 |
| 808 (Inv.) | 303 ($2 \times 10^{-6}$) | 0.14 | 86 | 0.20 | 98 | 0.32 | 90 |
| 809 (Inv.) | 308 ($1.5 \times 10^{-6}$) | 0.19 | 85 | 0.23 | 102 | 0.36 | 94 |

Comparative Compounds A, B and C are the same as Example 7.
*1Relative sensitivity.

Relative sensitivity is expressed by the value relative to that of Sample 801 containing the silver halide emulsion subjected to chemical ripening for 56 minutes, which was set at 100.

As is apparent from the results shown in Table 11, preferable results were obtained with the compounds of the present invention in that when a gold-sulfur-selenium sensitization is provided, they provide less fog while giving the same level of final sensitivity as with conventional Compounds (A) and (C). Further, in comparison with Compound (B) which gives rapid ripening while providing less fog, they provide moderate ripening. This is preferable for stably manufacturing a high sensitive emulsion.

EXAMPLE 9

Coated samples were prepared and processed in the same manner as in Example 3, except that the sensitizers shown in Table 12 were used. The processed samples were subjected to sensitometry in the same manner as in Example 3. Photographic sensitivity is defined by the reciprocal of an exposure necessary to give an optical density of fog +0.2 and expressed by a value relative to that of Sample 901 just after coating, which was set at 100. The results are shown in Table 12.

TABLE 12

| Sample No. | Compound (Add. amount. mol/mol AgX) | Just after Coating Fog | Just after Coating S*1 | After*2 Storage S*1 |
|---|---|---|---|---|
| 901 (Comp.) | A (Comp.) ($1.5 \times 10^{-6}$) | 0.30 | 100 | 79 |
| 902 (Comp.) | B (Comp.) ($2.5 \times 10^{-6}$) | 0.19 | 104 | 73 |
| 903 (Comp.) | C (Comp.) ($3.5 \times 10^{-6}$) | 0.27 | 94 | 71 |
| 904 (Inv.) | 104 ($1.5 \times 10^{-6}$) | 0.20 | 100 | 84 |
| 905 (Inv.) | 106 ($1.5 \times 10^{-6}$) | 0.18 | 104 | 88 |
| 906 (Inv.) | 203 ($2 \times 10^{-6}$) | 0.18 | 100 | 87 |
| 907 (Inv.) | 214 ($1.5 \times 10^{-6}$) | 0.22 | 95 | 82 |
| 908 (Inv.) | 303 ($2 \times 10^{-6}$) | 0.16 | 95 | 81 |
| 909 (Inv.) | 308 ($1.5 \times 10^{-6}$) | 0.21 | 100 | 85 |

Comparative Compounds A, B and C are the same as Example 7.
*1Relative sensitivity.
*2At 50° C. and 80% RH for 2 days.

As is apparent from the results shown in Table 12, preferable results are obtained with the compounds of the present invention in that when the compounds of the present invention are applied to a gold-sulfur-selenium sensitization, they provide low fog, which stands at the level of the Compound (B), while giving almost the same final sensitivity in comparison with conventional Compounds (A) and (C) and that they provide less sensitivity degradation after storage under high temperature and humidity conditions, particularly less than that of Compound (B).

Fog in sensitization with a selenium compound can be better prevented with the compounds of the present invention than with conventionally known compounds and the same level of high sensitivity can stably be provided. Further, a sensitivity change after storage under a high temperature and humidity conditions can be controlled.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, wherein at least one of the silver halide emulsion layers has been subjected to selenium sensitization with at least one compound represented by the following Formula (I):

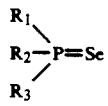

(I)

wherein $R_1$ represents a substituted phenyl or condensed aryl group, an aliphatic group, or a heterocyclic group; and $R_2$ and $R_3$ each represents an aliphatic group, an aromatic group, or a heterocyclic group.

2. A silver halide photographic material comprising a support having thereon at least one silver halide emulsion layer, wherein at least one of the silver halide emulsion layers has been subjected to selenium sensitization with at least one compound represented by the following Formula (I):

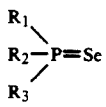

(I)

wherein $R_1$ represents $OR_4$; $R_2$ and $R_3$ each represents $OR_9$; $R_4$ represents a substituted alkyl group, an alkenyl group, an alkynyl group, a heterocyclic group, a hydrogen atom, or a cation; and $R_9$ represents an aliphatic group, an aromatic group, a heterocyclic group, a hydrogen atom, or a cation.

3. A silver halide photographic material comprising a support having thereon at least one silver halide emulsion layer, wherein at least one of the silver halide emulsion layers has been subjected to selenium sensitization with at least one compound represented by the following Formula (I):

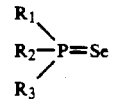

(I)

wherein $R_1$ represents $OR_4$; $R_2$ represents an aliphatic group, an aromatic group, or a heterocyclic group; $R_3$ represents $OR_9$, an aliphatic group, an aromatic group, or a heterocyclic group; and $R_4$ and $R_9$ each represents an aliphatic group, an aromatic group, a heterocyclic group, a hydrogen atom, or a cation.

4. A silver halide photographic material comprising a support having thereon at least one silver halide emulsion layer, wherein at least one of the silver halide emulsion layers has been subjected to selenium sensitization with at least one compound represented by the following Formula (I):

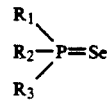

(I)

wherein $R_1$ represents $—NR_5(R_6)$, $SR_7$, $SeR_8$, $X_1$ or a hydrogen atom; $R_2$ and $R_3$ each represents an aliphatic group, an aromatic group, a heterocyclic group, $OR_9$, $—NR_{10}(R_{11})$, $SR_{12}$, $SeR_{13}$, $X_2$, or a hydrogen atom; $R_5$, $R_6$, $R_{10}$ and $R_{11}$ each represents an aliphatic group, an aromatic group, a heterocyclic group, or a hydrogen atom; $R_7$, $R_8$, $R_9$, $R_{12}$ and $R_{13}$ each represents an aliphatic group, an aromatic group, a heterocyclic group, a hydrogen atom, or a cation; and $X_1$ and $X_2$ each represents a halogen atom.

5. The silver halide photographic material any one of claims 1-4, wherein the amount of the compound is about $10^{-8}$ to $10^{-4}$ mole per mole of silver halide.

6. The silver halide photographic material any one of claims 1-4, wherein the silver halide emulsion layer which has been subjected to selenium sensitization, has also been subjected to noble metal sensitization.

7. The silver halide photographic material of claim 6, wherein the noble metal is gold.

8. The silver halide photographic material of claim 6, wherein the noble metal is platinum.

9. The silver halide photographic material of claim 6, wherein the noble metal is palladium.

10. The silver halide photographic material of claim 6, wherein the noble metal is iridium.

11. The silver halide photographic material of claim 6, wherein the selenium sensitization is carried out in the presence of a sulfur sensitizer.

12. The silver halide photographic material of claim 6, wherein the selenium sensitization is carried out in the presence of a silver halide solvent.

* * * * *